US006464132B1

(12) United States Patent
Duquet et al.

(10) Patent No.: US 6,464,132 B1
(45) Date of Patent: Oct. 15, 2002

(54) EASY ACCESS CARTON

(75) Inventors: Jacky Pierre Duquet, Herbeville (FR); José Arnau-Munoz, Montigny-le-Bretonneux (FR); Francis Wanwanscappel, Brunoy (FR)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/486,543

(22) PCT Filed: Aug. 14, 1998

(86) PCT No.: PCT/IB98/01466

§ 371 (c)(1),
(2), (4) Date: Nov. 9, 2000

(87) PCT Pub. No.: WO99/11527

PCT Pub. Date: Mar. 11, 1999

(30) Foreign Application Priority Data

Sep. 1, 1997 (EP) ..... 97202673

(51) Int. Cl.[7] ..... B65D 17/28; B65D 83/04

(52) U.S. Cl. ..... 229/221; 206/532; 206/535; 206/536; 229/940

(58) Field of Search ..... 229/221, 229, 229/232, 242, 940; 206/528, 532, 535, 536

(56) References Cited

U.S. PATENT DOCUMENTS

| | | | | | |
|---|---|---|---|---|---|
| 2,407,865 | A | * | 9/1946 | Biskamp | 229/221 |
| 3,756,502 | A | * | 9/1973 | Swanson et al. | 229/242 |
| 4,987,996 | A | * | 1/1991 | Anderson | 229/221 |
| 5,011,021 | A | * | 4/1991 | Coltrane et al. | 229/221 |
| 5,402,886 | A | * | 4/1995 | McGlinch | 229/242 |

FOREIGN PATENT DOCUMENTS

| | | | |
|---|---|---|---|
| DE | 1811339 | * | 6/1970 |
| DE | 19532968 A1 | * | 3/1997 |
| EP | 610537 A1 | * | 8/1994 |
| FR | 1181121 | * | 6/1959 |
| FR | 1568665 | * | 5/1969 |

* cited by examiner

*Primary Examiner*—Gary E. Elkins
(74) *Attorney, Agent, or Firm*—Marianne Dressman; Kim William Zerby; Steven W. Miller

(57) ABSTRACT

A carton and a die cut for such a carton comprise two parallel lines of weakness corresponding to two edges of a side of the carton. This allows the side to be fully opened by tearing open the lines of weakness, thus giving access along the full width of the opened side. The cartons provide maximized and facilitated access to the contents of the carton.

7 Claims, 7 Drawing Sheets

EASY ACCESS CARTON

TECHNICAL FIELD

The invention relates to a carton board container with an opening providing a maximized access to the content of the carton.

BACKGROUND OF THE INVENTION

Various types of containers are formed from carton board. Typical containers made from carton board, also simply called cartons, have a substantially parallelepipedal shape with six sides and twelve edges, namely the top, bottom, back, front, left and right sides, the edges being defined by the two sides of which they are the intersection, for example the back/top edge. For definition purposes, it will be considered in the following that when the carton is upright the top and bottom sides are in the horizontal plane, the four other sides being vertical. We will consider that if the front side of the upright carton is facing an observer, the left side is on to the left of the observer and the right side on to the right of the observer, the back side being invisible for the observer.

Such cartons are usually provided with opening means which allow opening of the carton to have access to its content. In order to facilitate opening, cartons are normally provided with opening means. Typically, opening means comprise lines of weakness which will allow opening when submitted to an external force. These lines of weakness usually define at least part of the perimeter of the opening on a side of the carton which opens.

The present invention relates to a carton, the carton being a parallelepiped carton with six substantially rectangular sides, comprising top and bottom sides opposing each other, left and right sides opposing each other, and front and back sides opposing each other, whereby the front side comprises opening means, the opening means comprising two parallel lines of weakness. Such a carton is known from WO 92/06894, published on the $30^{th}$ of April 1992.

Such cartons are usually folded and glued from a die cut. A die cut, or blank, is a flat structure which has not been folded or glued. A die cut is preferably made from a single piece for costs reasons. A die cut normally has a specific grain direction. This means that the material forming the die cut is not isotropic but has a preferred direction along which the die cut is more resistant. This direction is the grain direction. For corrugated cardboard, the equivalent of the grain direction is the direction of the corrugations.

For stiffness reasons, it is important that the grain direction is not horizontal, and preferably vertical during stacking and transport of the carton. This means that the direction of gravity should be the grain direction when the carton is stacked or transported.

The present invention relates to a die cut, the die cut comprising a substantially rectangular panel delimited by four folding lines corresponding to the edges of the rectangle, the panel further comprising opening means, the opening means comprising two parallel lines of weakness. Such a die cut is also known from WO 92/06894, published on the $30^{th}$ of April 1992.

Among the advantages of such cartons or cartons made from such die cuts is that opening is greatly facilitated by the lines of weakness which tear open easily, thus giving access to the content of the carton through the opening formed, the opening having a width limited by the lines of weakness on each end, the width being measured perpendicularly to the lines of weakness. While having this advantage, an opening obtained by such opening means does not usually provide a maximized access to the content of the carton. Indeed, the lines of weakness are placed so that the width of the opening does not correspond to the width of the side of the carton on which the opening is made: the lines of weakness are placed somewhere on the side in between the edges of the side, so that there is a part which does not open, the part being comprised between each edge of the side parallel to the lines of weakness and the line of weakness closer to this edge. This space thus takes the form of two shoulders on each side of the opening.

Accordingly, it is an object of the present invention to produce a carton and a die cut for a carton of the above mentioned kind which provides a maximized access to the content of the carton.

SUMMARY OF THE INVENTION

In accordance with the invention, this object is accomplished in a carton of the above mentioned kind in that the first line of weakness is on the edge at the intersection of the front and left sides and the second line of weakness is on the edge at the intersection of the front and right sides.

In another aspect of the invention, this object is accomplished in a die cut of the above mentioned kind in that the first line of weakness is on a first folding line and the second line of weakness is on a second folding line, the second folding line being the folding line parallel to the first folding line.

BRIEF DESCRIPTION OF THE DRAWINGS

The invention will now be described by way of example and with reference to the accompanying drawings in which.

DESCRIPTION OF THE PREFERRED EMBODIMENTS

Figure 1:
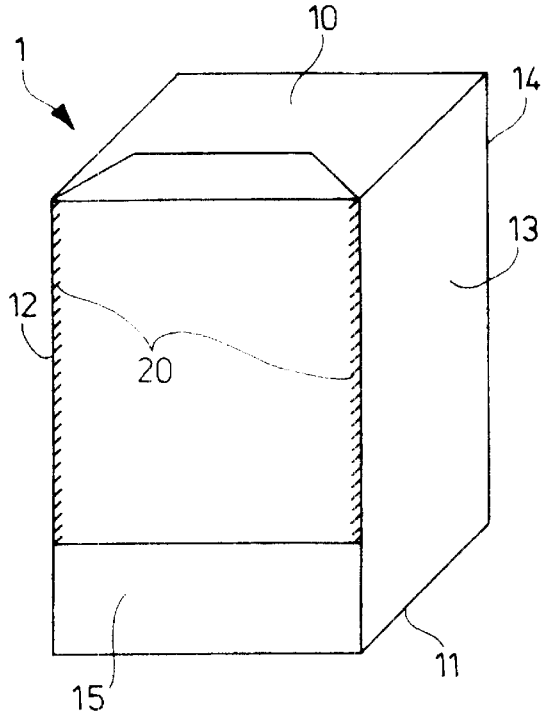
FIG. 1 is a perspective view of a preferred embodiment of a closed carton according to the present invention.
Figure 2:
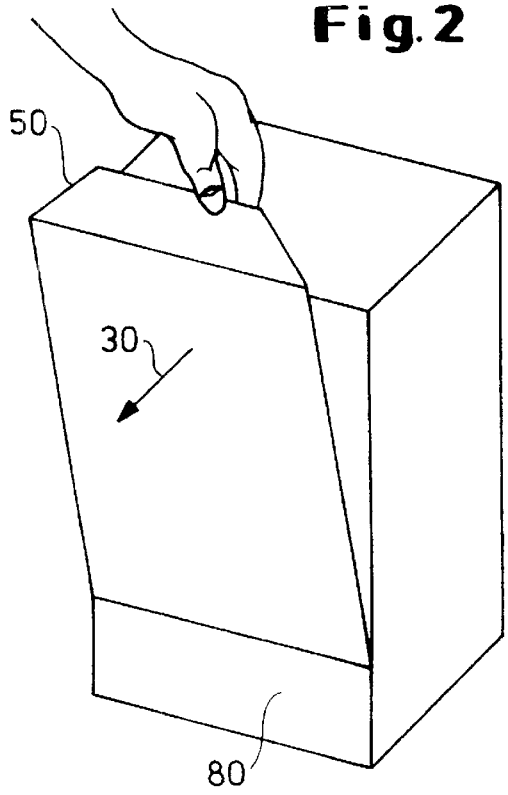
FIG. 2 is a perspective view of a preferred embodiment of a carton according to the present invention while being opened.
Figure 3:
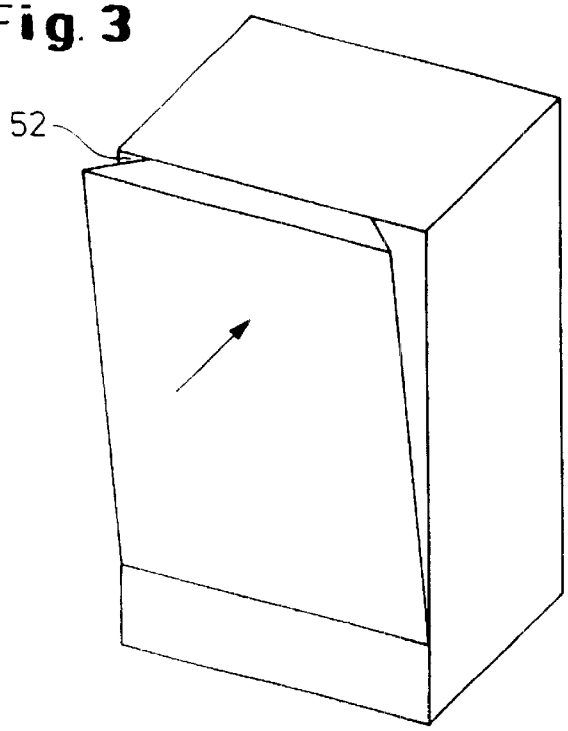
FIG. 3 is a perspective view of a preferred embodiment of a carton according to the present invention while being re-closed.
Figure 4:
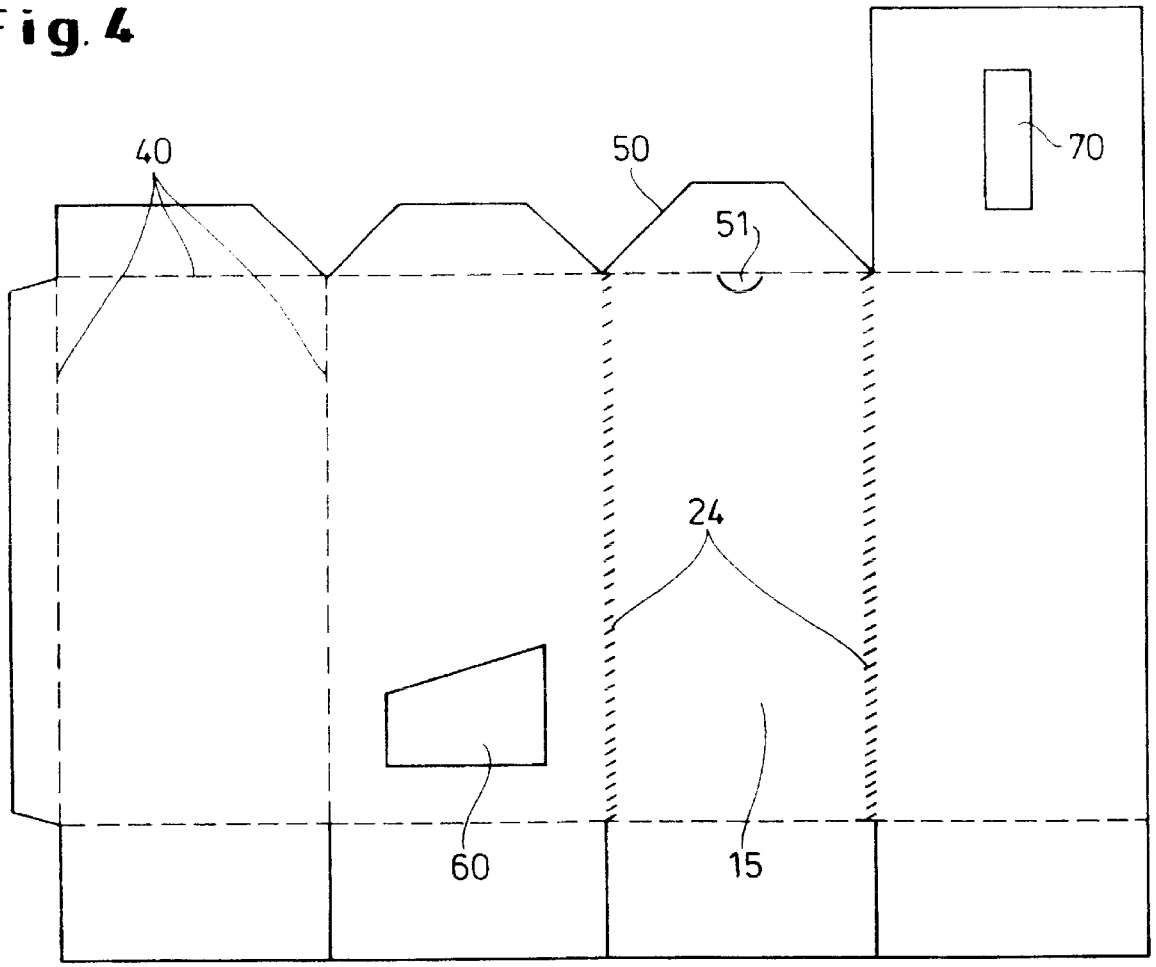
FIG. 4 is a top plan view of another preferred embodiment of a die cut of the present invention.
Figure 5:
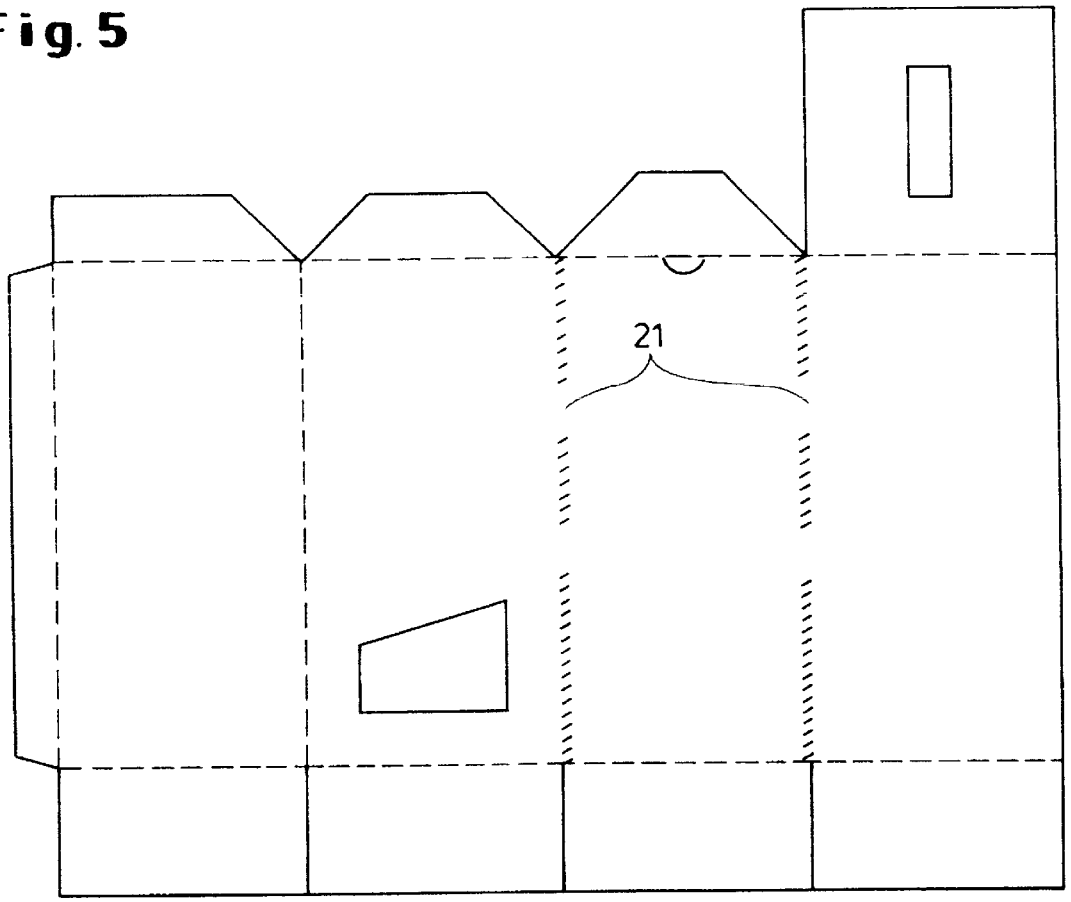
FIG. 5 is a top plan view of yet another preferred embodiment of a die cut of the present invention.
Figure 6:
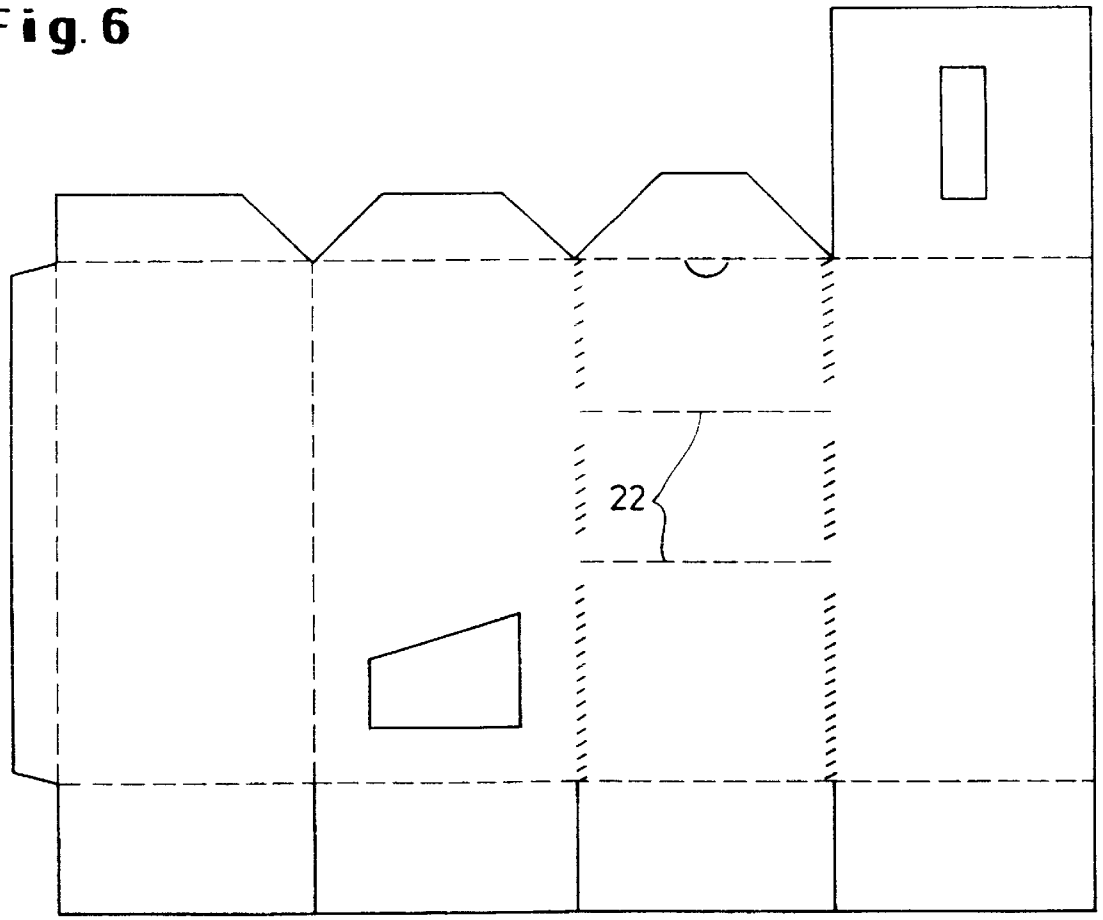
FIG. 6 is a top plan view of an additional preferred embodiment of a die cut of the present invention.
Figure 7:
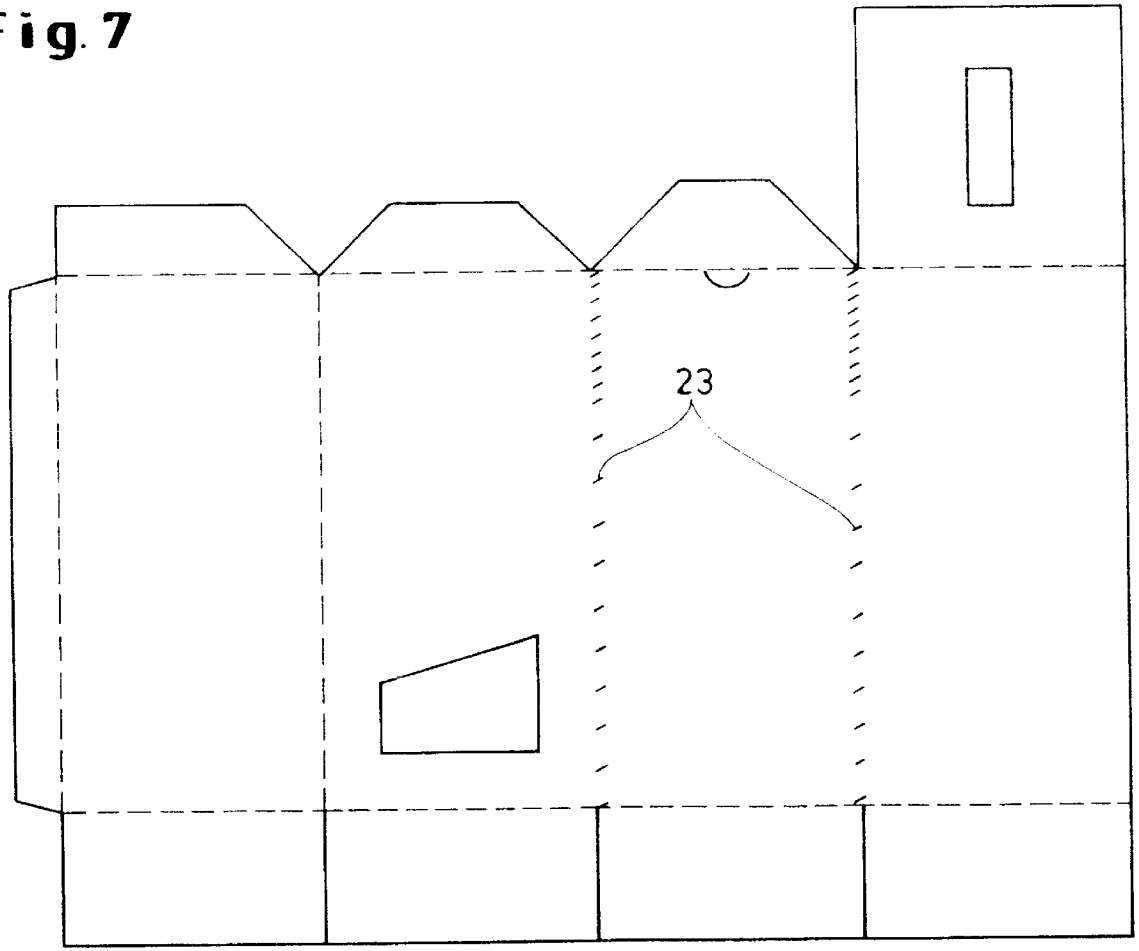
FIG. 7 is a top plan view of a further preferred embodiment of a die cut of the present invention.
Figure 8:
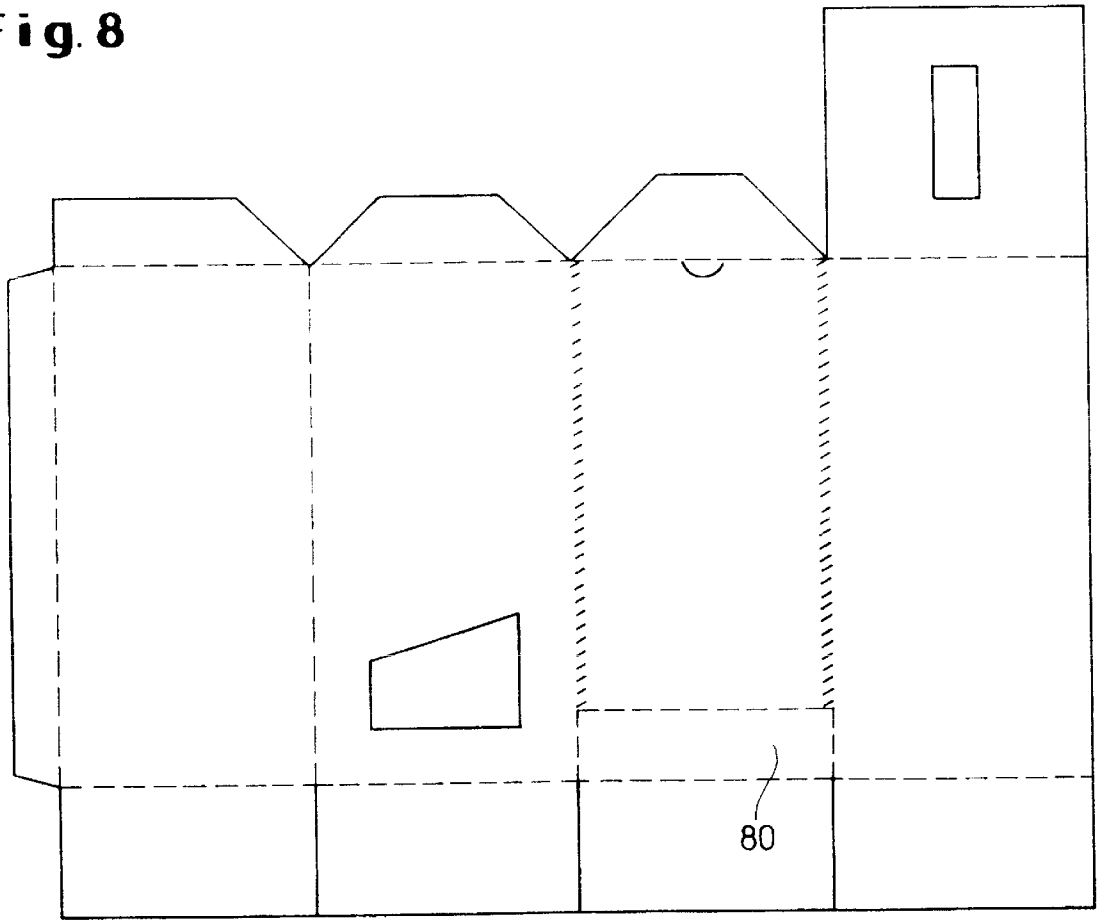
FIG. 8 is a top plan view of yet another preferred embodiment of a die cut of the present invention.
Figure 9:
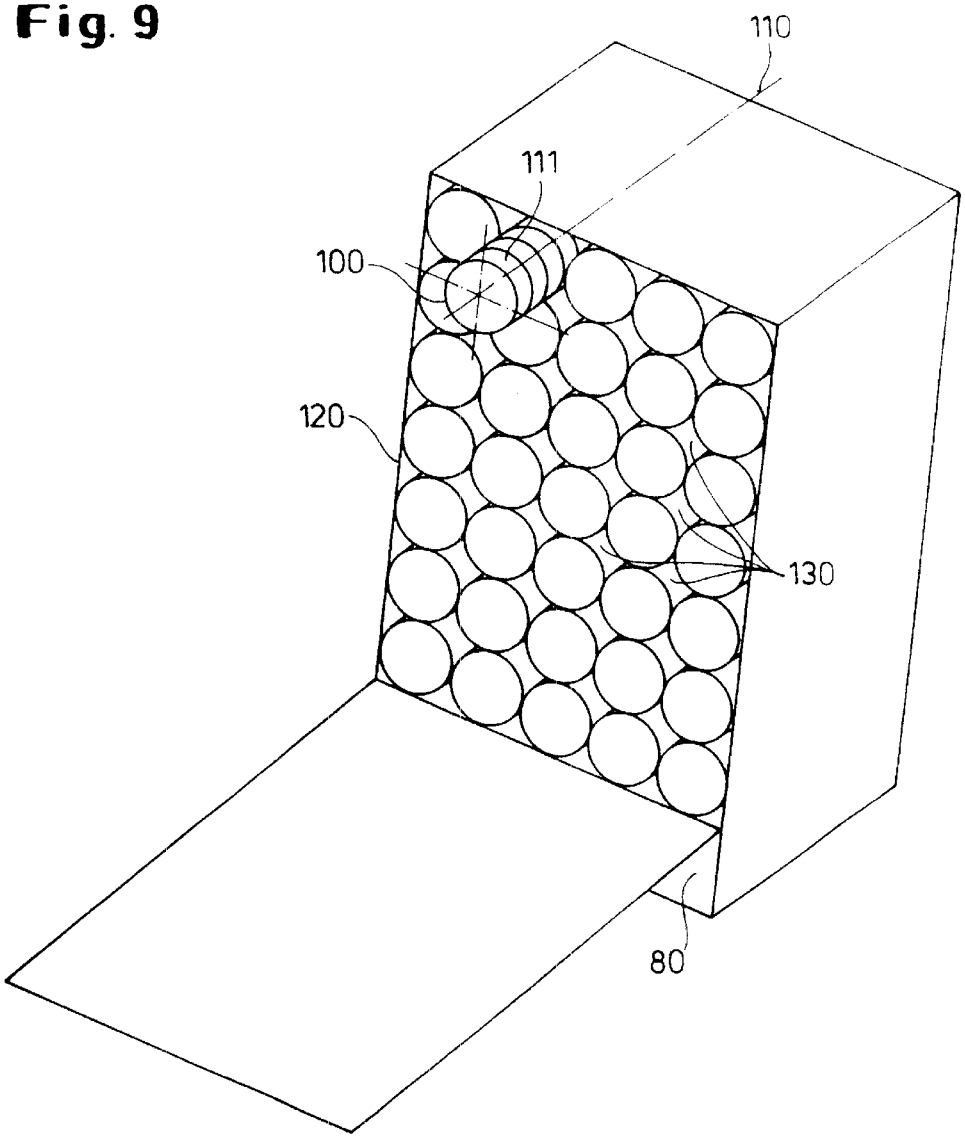
FIG. 9 is a perspective view of a most preferred embodiment of an opened carton according to the present invention.

The carton (1) of the present invention is preferably made of cardboard or corrugated board such as mini micro, micro or B fluting, but other materials could also be used. The cartons normally have a parallelepipedal shape with six sides. The sides can be defined as a top (10), bottom (11), left (12), right (13), back (14) and front (15) sides. The top side is on the top of the carton when the carton is in its upright position, the bottom side being opposite to the top side. For the purpose of the description, the front and back sides are opposing sides and the left and right side are opposite sides as well. Each of these sides can be made of several layers of material. Each of the sides is usually of a substantially rectangular shape, each side being limited at its borders by four edges. The structure of the carton is due to links which can exist between different layers of different sides through the edges. For example, if the front side is made of a single layer, this layer may be linked to the left side through the edge between the two sides, the link and the edge being provided by a folded line (40) or/and by glue. The layers which compose the sides of the carton may be of different sorts. If such a layer is covering a complete side, it is called a panel, and is said as corresponding to the side it covers. When a layer covers a side only partially, it is called a flap, and it is said that it corresponds to the side it covers. However, a flap may be extended up to the panel size, in which case it is a long flap. Long flaps are particularly used for contributing to the rigidity of the structure. Flaps and panels can also comprise cut outs allowing use of a minimum amount of materials. Panels or flaps can be said as associated to another layer, which means that they have a side in common with this layer through a folded line or score line, in doing so describing an edge of the carton. Each side may comprise one or more panels, one or more flaps, or a combination of these. In the present application, the panels may have in their denomination the name of the side of which they cover the surface, for example the front panel corresponds to the front side. In the present application the flaps may have in their denomination the name of the side with which they correspond once the carton is folded, followed of the name of the flap or panel with which they are associated. For example, the first top flap associated with an edge to the front panel is forming part of the top side in the folded carton and is physically attached the front panel with a folding line. It should be noted that the side denomination, namely left, right, top, bottom, back and front, are conventional denominations which are introduced for ease of explanation, and should not be limiting. In order to complete the structure, some flaps and panels may be linked to each other not by folding lines but by glue. The glue can be applied in different ways. For example, cold glue can be used, applied with rollers or glue guns, but also hot glue, whether applied with glue guns or pattern plates.

The carton according to the present application comprising an opening means. An opening means consists in a feature which is included to the carton, the function of this feature being to facilitate the opening of this carton. In the present application, the opening means comprises two parallel lines of weakness (20). A line of weakness on a carton consists in a linear portion which has a voluntarily weakened structure, so that the material forming the carton will collapse preferably along this linear portion once a force (30) is applied to this purpose. The intensity of the force needed depends on the material used and on the way the line of weakness is manufactured. Indeed, a line of weakness can be provided thanks to perforations, but it can also consist in a partial cut. The function of a line of weakness is to avoid opening the carton in an uncontrolled manner. Indeed, the perimeter of the opening provided in the carton will preferably follow the lines of weakness provided.

The opening means of the present application comprises two of such lines of weakness which are parallel. Other features could be included in the opening means also, in order to further facilitate opening. Such features include for example providing the carton with an extra flap for easy pulling (50), or a notch (51) which could also facilitate pulling, as well as other means for facilitating the application of the opening force (30). It should be noted that the carton of the invention may comprise other opening means on other sides. For example, the carton may be openable both on the front and back sides, thus giving two separated accesses to the content of the carton. This can be used for example for dispensing the content in two basic steps. The carton may comprise a divider for that purpose.

The two lines of weakness of the carton of the invention are on the edges forming the intersection of the left and front sides and the intersection of the right and front sides. Considering the structure of the carton, the lines of weakness are consequently parallel, as the left and right sides are opposing each other, and the sides of the carton are substantially rectangular. As explained, the lines of weakness will be part of the perimeter of the opening. This means that the opening will go from one edge of the carton to the other, i.e. from the left side/front side edge to the right side/front side edge. Consequently, the access to the content of the carton along the direction perpendicular to the direction of the lines of weakness is maximum. However, the lines of weakness may not be provided all along the left side/front side or right side/front side edges. This means that, although the opening is going from one edge to the other in the direction perpendicular to the direction of the lines of weakness, it may be only partial along the other direction, i.e. the direction of the lines of weakness. Partial opening may be due to the fact that the lines of weakness do not go all the way from the top side/front side edge to the bottom side/front side edge. Partial opening may also be due to the fact that the opening means may be a progressive opening means. Examples of a progressive opening means are including the following: the lines of weakness may be interrupted by normal sections of material (21), so that opening could be made in successive steps, giving access to successive parts of the carton, extra folding lines (22) being optional to facilitate step opening. The lines of weakness themselves may also be made in such a manner that they are making the opening progressively more difficult, this being achieved for example by spacing more or less perforations according to the progressively required (23), if the lines of weakness are perforated lines.

The carton may also comprise a reclosing means (52). Such a feature allows reclosure after the first opening. For example, a reclosing means can be provided by an extra flap which can be slided in the carton to hold the opened panel in place when re-closed. Other features can be used which are known in the art, such as snaplock mechanisms. The carton may also be such that the panel which opens can be removed once the carton is opened.

The carton may also comprise various other features comprising a window (60) for visualising the product, or a handle (70) to facilitate transportation by the user. In case of a carton having a window, it should be noted that a window may have an influence on the structure of the carton, as it may weaken the strength of the side on which it is provided.

The carton may also comprise a retaining means (80). A retaining means is a feature which prevents the content from coming out of the carton in an undesired manner. For example, a portion of the front face main be kept unopenable by stopping the lines of weakness before reaching the edge with the bottom side, so that the content of the carton will be retained when the carton is upright.

In a preferred embodiment of the invention, the carton contains at least a solid stack (100). A solid stack is a pile, heap or group of solid objects arranged in an orderly fashion.

The solid stack (100) has a main direction. By a main direction it is meant that the solid objects are ordered to form the stack following a particular direction which is the main direction of the stack. A solid stack having a main direction is consequently particularly rigid and solid along this main direction (110).

More preferably, the carton of the invention contains a plurality of solid stacks which are placed in the carton so as to maximize the number of solid stacks contained. The solid stack is preferably made from a pile of tablets like portions. The solid stack has a main direction (110) and a cross section in the plane normal to the main direction. The cross section of the solid stack may be circular, in which case the carton cannot be completely filed with solid stacks, as a rectangular surface cannot be covered with non intersecting disks. The cross section may also have other shapes. The cross section may for example be substantially rectangular, in which case the carton may be completely filled with the solid stacks if the dimensions of the solid stacks are suitable. Indeed, the dimensions of the carton and the dimensions of the solid stack or of the plurality of solid stacks contained should be adapted to each other in order to minimize waste of volume. For example, if the solid stack has a square cross section, the space inside the carton should have a cross section with dimensions equal to a multiple of the side of the square cross section of the solid stack. The advantage of minimizing the waste of space within the carton is that there is less material used, so that such an arrangement is more environmentally friendly. However, such an advantage should not prevent easy access to the content of the carton. Indeed, such easy access is given when using the carton of the invention.

In the preferred embodiment of the invention, the solid stack is placed so that the main direction (110) is perpendicular to the front side. As the front side comprises the opening means according to the invention, the user will have access to the solid stack from this opening means and should grab it and pull it out from this side. In normal carton, such a disposition would cause difficulty to take the solid stack out because the opening in a normal carton normally leaves shoulders, so that the opening will not be provided along the full width of the front side perpendicular to the lines of weakness. However, in the carton according to the invention, as opening is provided along the full width of the front face perpendicular to the direction of the lines of weakness, the access is optimized. For example, if the lines of weakness on the front side have the same length than the front side (24), the front side could be completely opened, so that the content of the carton could be removed at once. In an other case, the opening may be a progressive opening. This is particularly useful if the carton is containing a plurality of solid stacks which are placed in an ordered manner. For example, solid stacks may be disposed in a plurality of layers (120), the layers being perpendicular to the direction of the lines of weakness, so that a progressive opening may give access to successive layers the one after the other. The key point is that the cross section of each solid stack contained in the carton should be completely accessible for the user from the opening, with the exception of solid stacks which may be retained by a retaining means which may be useful for conferring stability to the assembly. Indeed, in a preferred embodiment of the invention, the carton is placed with its front side perpendicular to the ground when used, so that the user may have an easier access to the content, and so that the content may have to be retained from coming out of the carton at once in an undesired manner. Once opened, the content should be easy to remove from the carton. For example, if solid stacks (100) with a circular cross section are contained in the carton, the user can insert his fingers in the space left free (130) between adjacent solid stacks to grab the desired solid stack and pull it out. If solid stacks with a rectangular cross section are contained within the carton, they may be grabbed by the user by the end of a bag or sachet or by any other known grabbing means. Indeed, the solid stacks may be individually packed in bags or sachets which may have the function of sachets can be made from a wrapper, whereby the user can pull the sachet out of the carton by grabbing an extremity of the wrapper. In a preferred embodiment, the carton is containing a plurality of solid stacks of detergent tablets, the solid stacks being in a wrapper, whereby the wrapper has reclosing means such as a twist for example, so that the user can grab the twist end of the wrapper to pull the solid stacks out of the carton.

Placing the lines of weakness at the edges of a carton according to the invention may cause a weakening of the structure of the carton. The weakening of the structure may be compensated. Indeed, the content may be such that it has at least one point of contact with each of the front and back sides of the carton. In such a case, the structure of the carton will be able to co-operate with the content in such a manner that the whole structure will be reinforced. For example, if the carton contains a solid stack with a rectangular cross section so that each of the front and back sides of the carton is in contact with an extremity of the solid stack, the rigidity of the solid stack will co-operate to the rigidity of the carton and the whole structure will be consequently more rigid: the carton will hold the solid stack and the solid stack will improve the rigidity of the carton, so that the carton structure and the solid stack structure synergistically co-operate to form a whole structure with improved rigidity and solidity. This synergistic effect is particularly useful if the structure is weakened further by a window (60) and if the content of the carton is particularly brittle or fragile, as is the case for detergent tablets (111). Indeed, the carton of the invention is particularly suited for storing, protecting and dispensing solid stacks of such detergent tablets. In this case, it is preferred if the carton is made from a material comprising a moisture barrier, as detergent tablets are more fragile when exposed to moisture.

The structure reinforcement aspect may be brought together with the easy access aspect. Indeed, structure reinforcement is particularly important during stacking of carton and during transportation. In a preferred embodiment of the invention, the carton contains a solid stack, the main direction of the solid stack being normal to the front side of the carton, thus facilitating easy access as explained above, and the carton being stacked and transported with the front side being horizontal, so that the edges corresponding to the lines of weakness are not in the direction of gravity, so that they are not supporting edges, and while the main direction of the solid stack is in the direction of gravity, in such a manner that the structure of the carton is further reinforced by the structure of the solid stack. In this particular preferred embodiment, the carton is transported or stacked with the front side horizontal, but is used with the front side being vertical, thus facilitating the access to the content for the user and allow package distinctivity. The structure may be even more reinforced if the grain direction of at least one of the left, right, top or bottom sides of the carton is along the main direction of the solid stack, i.e. perpendicular to the front side of the carton. Indeed, in such a case, the grain direction will correspond to the direction of gravity if the carton is transported with the front face being horizontal, so that the grain direction will participate in supporting the structure. Same applies for the corrugation direction in case of use of a corrugated material. In a most preferred embodiment of the invention, all of the right, left, top and bottom sides of the carton have a grain direction in the same direction as the main direction of the solid stacks (110). This depends on the manner that the die cut is made and designed for the carton.

What is claimed is:

1. A carton (1), the carton being a parallelepiped carton with six substantially rectangular sides, comprising top (10) and bottom (11) sides opposing each other, left (12) and right (13) sides opposing each other, and front (15) and back (14) sides opposing each other, wherein the front and left sides and the front and right sides each intersect to form an edge, and whereby the front side (15) comprises opening means, the opening means comprising two parallel lines of weakness (20), characterized in that the first line of weakness is on the edge at the intersection of the front and left sides and the second line of weakness is on the edge at the intersection of the front and right sides and further wherein the carton has a content, the content comprising at least a solid stack, the solid stack comprising a pile, heap or group of solid objects (100).

2. The carton (1) according to claim 1 wherein the solid stack has a main direction (110), the main direction being normal to the front side, so that the solid stack reinforces the structure of the carton.

3. The carton (1) according to claim 1, whereby the content of the carton has at least one point of contact with each of the front and back sides of the carton prior to first opening of the carton.

4. The carton (1) according to claim 1, whereby the carton has a grain direction, the grain direction of at least one of the left, right, top or bottom sides being the direction of the main direction of the solid stack (110), so that the structure of the carton is reinforced further.

5. The carton (1) according to claim 1, whereby the solid stack is made of a plurality of tablets (111), the tablets being piled along the main direction of the solid stack (110).

6. The carton (1) according to claim 1, whereby the carton further comprises a reclosing means (52).

7. The carton according to claim 1, whereby the opening means is a progressive opening means (21, 22, 23).

* * * * *